US007617941B2

(12) United States Patent
Colin et al.

(10) Patent No.: US 7,617,941 B2
(45) Date of Patent: Nov. 17, 2009

(54) MODULAR WIRE DISPLAY RACK

(75) Inventors: Maria Alejandra Noble Colin, Mexico City (MX); Juan Manuel Avila Barriga, Mexico City (MX)

(73) Assignee: Sabritas, S. de R.L. de C.V., Colonia Lomas de Chapultepec, D. F. (MX)

( * ) Notice: Subject to any disclaimer, the term of this patent is extended or adjusted under 35 U.S.C. 154(b) by 180 days.

(21) Appl. No.: 11/461,659

(22) Filed: Aug. 1, 2006

(65) Prior Publication Data

US 2008/0029467 A1 Feb. 7, 2008

(51) Int. Cl.

| | |
|---|---|
| ***A47F 7/00*** | (2006.01) |
| ***A47B 57/00*** | (2006.01) |
| ***B65D 6/08*** | (2006.01) |
| ***B65D 21/00*** | (2006.01) |

(52) U.S. Cl. ..... 211/59.2; 211/194; 220/485; 206/503; 206/504

(58) Field of Classification Search ..... 211/44, 211/49.1, 59.2, 74, 75, 85.26, 85.31, 126.1, 211/126.12, 126.2, 126.9, 188, 194, 87.01, 211/90.01, 90.03, 106, 88.01; 312/9.9, 10; D6/407, 408, 458–460, 462–465, 512, 515, D6/552; 220/23.2, 23.4, 23.6, 511, 743; 206/503, 504, 509; 248/235, 249; 403/331
See application file for complete search history.

(56) References Cited

U.S. PATENT DOCUMENTS

| | | | | | |
|---|---|---|---|---|---|
| 580,655 | A * | 4/1897 | Thew | ..... | 211/85.17 |
| 642,985 | A * | 2/1900 | Horton | ..... | 211/104 |
| 1,660,410 | A * | 2/1928 | Beckman | ..... | 220/486 |
| 1,870,005 | A * | 8/1932 | Gutsch | ..... | 312/107 |
| 1,955,236 | A * | 4/1934 | Jarvis | ..... | 206/512 |
| 1,974,290 | A * | 9/1934 | Pawsat | ..... | 220/511 |
| 1,992,411 | A * | 2/1935 | Bruce | ..... | 206/202 |
| 2,046,095 | A * | 6/1936 | Shaw | ..... | 211/85.17 |

(Continued)

OTHER PUBLICATIONS

L.K. Goodwin Co.; www.lkgoodwin.com//more_info/plastic_storage_bins/ plastic_storage_bins.shtml; Dec. 7, 2005.

(Continued)

*Primary Examiner*—Lanna Mai
*Assistant Examiner*—Joshu Rodden
(74) *Attorney, Agent, or Firm*—Bobby W. Braxton; Carstens & Cahoon, LLP

(57) ABSTRACT

A product display rack having a plurality of interlocking modular units, each of which are capable of tessellation. Preferably, each unit comprises: four parallel wire members, the first and second of which define a base, and the third and fourth of which define a top; a first L-shaped flange and a second, parallel L-shaped flange, wherein said first and second L-shaped flanges are attached and parallel to said first and third wire members, respectively, and wherein further the first and second L-shaped flanges have their own respective receiving portions that face each other; a third L-shaped flange and a fourth, parallel L-shaped flange, wherein said third and fourth L-shaped flanges are attached and parallel to said third and fourth wire members, respectively, and wherein further the third and fourth L-shaped flanges each have their own respective receiving portions that face each other.

20 Claims, 13 Drawing Sheets

U.S. PATENT DOCUMENTS 2,119,700 A * 6/1938 Burgess ..... 211/59.2
2,122,322 A * 6/1938 Kidwell et al. ..... 211/59.2
2,123,837 A * 7/1938 Thomas et al. ..... 211/85.31
2,125,000 A * 7/1938 Considine ..... 211/59.2
2,125,557 A * 8/1938 Goldman ..... 211/59.2
2,223,554 A * 12/1940 Davis ..... 206/510
2,239,369 A * 4/1941 Nauert ..... 211/14
2,262,794 A * 11/1941 Burbank et al. ..... 211/85.5
2,289,751 A * 7/1942 Brenholt ..... 211/59.2
2,302,140 A * 11/1942 Paulin ..... 211/49.1
2,330,852 A * 10/1943 White ..... 108/53.5
2,334,825 A * 11/1943 Jones ..... 211/126.2
2,364,705 A * 12/1944 Geralds ..... 206/510
2,467,696 A * 4/1949 Powell ..... 206/202
2,497,574 A * 2/1950 Bahnson ..... 242/130.3
2,554,232 A * 5/1951 Young, Jr. ..... 211/126.9
2,588,618 A * 3/1952 Di Renzo ..... 312/49
2,620,083 A * 12/1952 Moorhead ..... 206/509
2,646,186 A * 7/1953 Russell ..... 206/510
2,655,267 A * 10/1953 Planeta ..... 211/74
2,660,328 A * 11/1953 Averill ..... 220/6
2,666,552 A * 1/1954 Coit, Jr. ..... 206/511
2,669,361 A * 2/1954 Just ..... 211/59.2
2,693,385 A * 11/1954 Cavalli et al. ..... 206/431
2,702,641 A * 2/1955 Arthur ..... 211/85.18
2,736,453 A * 2/1956 Russell ..... 206/510
2,853,202 A * 9/1958 Swingle ..... 206/202
2,865,527 A * 12/1958 Bloomquist ..... 220/494
2,985,332 A * 5/1961 Fredrick ..... 220/6
D192,378 S * 3/1962 Combs ..... D6/408
3,082,879 A * 3/1963 Wilson ..... 211/126.8
3,083,836 A * 4/1963 Bussemer ..... 211/134
3,160,308 A * 12/1964 Hare et al. ..... 220/491
3,202,295 A * 8/1965 Drader ..... 211/126.6
3,203,553 A * 8/1965 Pendergrast, Jr. et al. .. 211/59.2
3,203,557 A * 8/1965 Ettlinger, Jr. ..... 211/41.4
3,286,846 A * 11/1966 Brandes ..... 211/59.2
3,334,766 A * 8/1967 Rogus ..... 220/491
3,358,868 A * 12/1967 Purucker ..... 220/491
3,378,161 A * 4/1968 Lookabaugh ..... 220/6
3,401,993 A * 9/1968 Fenkel ..... 312/111
3,606,022 A * 9/1971 Beesley ..... 211/59.2
3,784,022 A * 1/1974 Beesley, Jr. ..... 211/59.2
3,917,103 A * 11/1975 Beretta ..... 220/6
4,079,836 A * 3/1978 Von Stein et al. ..... 206/513
4,117,783 A * 10/1978 Eckel et al. ..... 108/91
4,169,416 A * 10/1979 Haynes et al. ..... 108/26
4,298,127 A 11/1981 Upshaw et al.
4,426,008 A * 1/1984 Olson et al. ..... 211/59.2
4,437,412 A * 3/1984 Trautsch ..... 108/56.1
4,444,320 A 4/1984 Chap
4,456,125 A * 6/1984 Chap ..... 206/513
4,494,667 A * 1/1985 Griffith ..... 220/486
4,508,230 A * 4/1985 Ashton ..... 211/126.9
4,577,914 A * 3/1986 Stravitz ..... 312/9.9
4,685,633 A * 8/1987 Pellini ..... 242/598.3
4,705,178 A * 11/1987 Vail et al. ..... 211/126.9
4,848,620 A 7/1989 Chap
5,022,540 A 6/1991 Vail, Sr. et al.
5,097,971 A 3/1992 Norris et al.
5,123,545 A * 6/1992 Hickman ..... 211/59.2
D347,922 S * 6/1994 Trevaskis ..... D6/515
5,580,018 A * 12/1996 Remmers ..... 248/235
5,791,265 A * 8/1998 Ellsworth et al. ..... 108/180
D398,460 S 9/1998 Gerstner
6,123,034 A * 9/2000 Moore ..... 108/180
D436,761 S * 1/2001 Stravitz ..... D6/478
D446,968 S * 8/2001 Spencer ..... D6/462
6,318,570 B1 * 11/2001 Mueller et al. ..... 211/181.1
6,431,375 B2 * 8/2002 Spencer ..... 211/106
6,497,331 B1 * 12/2002 Morandi ..... 211/153
7,168,580 B2 * 1/2007 Larimer et al. ..... 211/200
D562,590 S * 2/2008 Colin et al. ..... D6/462
2003/0173322 A1 * 9/2003 Rushing ..... 211/181.1
2004/0035807 A1 * 2/2004 Marraffa ..... 211/49.1
2004/0217077 A1 * 11/2004 Gerstner et al. ..... 211/194
2006/0043034 A1 * 3/2006 Vanderslice ..... 211/59.2
2006/0283819 A1 * 12/2006 Larsen et al. ..... 211/59.2
2007/0215566 A1 * 9/2007 Shen et al. ..... 211/85.5

OTHER PUBLICATIONS

Stacks and Stacks Homewares; http://stacksandstacks.com/html/75046_ventilated-stacking-bins-set-of-6.htm; Dec. 7, 2005.
ebay.com; http://cgi.ebay.com/ws/eBayISAPI.dll?ViewItem&item=5619329073&category=55851; Dec. 7, 2005.
Froogle Online Shopping; http://froogle.google.com/froogle?q=stackable+display+bins&h1=en&lr=&sa=N&tab=ff&oi=froogler; Dec. 7, 2005.
Hubert Company Online Store; www.hubert.com/store/p-detail.asp?c=139&s=1289&ss=14973&p=826; Dec. 7, 2005.
Google; www.google.com/search?q=interlocking+wire+display+bins+for+chip+bags&h1=en&lr&start=30&sa=N; Dec. 6, 2005.
Organize-Everything.com; www.organize-everything.com/stacbassmalw.html; Dec. 6, 2005.
simplastics.com; http://www.simplastics.com/items.asp?subcat=11; Dec. 6, 2005.
shop.com; http://www.shop.com/op/~Set_of_4_Wire_Storage_Cubes-prod-14226166; Dec. 6, 2005.

* cited by examiner

MODULAR WIRE DISPLAY RACK

BACKGROUND OF THE INVENTION

1. Technical Field

The present invention relates generally to a display shelving system. More specifically, the invention relates to a modular wire-rack display having a plurality of interlocking units. Each interlocking unit has two pairs of L-shaped receiving tabs for attaching to adjacent units.

2. Description of Related Art

Retail display shelving commonly used in grocery stores, department stores, discount stores, and other retail outlets that display items on shelves, are manufactured by numerous companies in a plethora of models and design choices. The units that are typically found in a grocery store to display items for sale, such as bags of salty snacks, are typically self-contained with multiple shelves.

Although there are variations amongst the units offered by different manufacturing companies, the basic design is fairly well established, and there are many common features shared industry wide. In the prior art, a common display apparatus is a gondola-type unit, which typically has a back panel vertically oriented and held in position by connection to at least one upright, which is also vertically oriented. The connection to the upright is accomplished by at least a bottom rail, a center rail, and a top rail, although more horizontal rails can be used for this purpose. The vertical uprights are stabilized by at least one, and typically two, base legs or brackets. One or more shelves can be horizontally positioned in numerous locations relative to the back panel by virtue of connections between the shelf and the uprights. A base deck or shelf is maintained off of the surface upon which the entire unit sits by being supported by the base brackets. A closed base front encloses the space beneath the base deck in conjunction with the base deck and base bracket trim, when said base and trim also covers the base brackets. The gondola unit may have other trim components, such as the upright and trim, which cover the upright. A disadvantage of such a gondola system is that the shelves cannot be moved to different positions or locations while carrying product. Thus, every time a shelf is to be moved, all product must be unloaded, the shelf must be moved, and the product must be restocked. A similar problem is shared with many prior art wire-rack display systems. It would be desirable to have a single unit with shelves and/or units that could be easily moved without removing product.

Many existing modular wire-rack units require accessory items—such as binding clips, nuts and bolts, or other connecting members—in order to join adjacent units. This is undesirable, as such connecting members are separate from the wire-rack units and are thus easily lost. Furthermore, if one's wire-rack units are likely to be rearranged in the future, any extra connecting members must be stored apart from the wire-rack units for possible future use. Another disadvantage is that separate connecting members may offer inter-unit links that are relatively weak, easily broken, and/or easily removed. It would be desirable for each wire-rack unit to have integrated connecting members for robustness and ease of use.

Few, if any, prior art nodular wire-rack units are capable of gravity-fed product display. As product is removed from the front of a stocked gravity-fed shelf or unit, the next product in line tends to slide down to take the removed-product's place at the lower, front end of the shelf or unit. This provides the consumer with the clean, organized appearance of a fully-stocked product display. It would therefore be desirable for a modular wire-rack display unit to have a gravity-fed product display.

FIG. 1 is a perspective view of one example of a prior art, modular wire-rack unit 100. FIG. 2 is a perspective view of several of the prior art units shown in FIG. 1 stacked vertically. The depicted wire-rack unit 100 has a top surface defined by top-surface wire members 10, a bottom surface defined by bottom-surface wire members 20, two sides and a back surface defined by vertical corner wire members 30. Lateral supporting wire members 22 and lateral label-supporting wire members 26 provide surfaces for several attaching label holders 40. Additional support is offered by bottom longitudinal wire members 24 and vertical supporting wire members 32. If desired, the unit 100 can be attached to the wall using wall-mounting tabs. Note that the bottom surface is level (horizontal). Because the bottom surface is not sloped, it is not capable of gravity-fed product display. This can be undesirable and difficult for consumers trying to reach product at the back of the unit, especially if the unit is on or near the ground. Moreover, the prior art wire-rack unit 100 does not have any built-in joining or attaching mechanisms. Thus, accessory connectors, such as wire clips, binding collars, etc., must be obtained and applied to join adjacent units.

Nothing in the prior art addresses the problem associated with changing the position of a wire-rack display unit without first removing the product. A need also exists for each wire-rack unit to have integrated connecting members for robustness and ease of use. Furthermore, a need exists for a modular wire-rack display system capable of gravity-fed product display. The present invention fills these needs and other needs as detailed more fully below.

BRIEF SUMMARY OF THE INVENTION

A preferred embodiment of the present invention provides a product display rack having a plurality of interlocking modular units, each of which are capable of tessellation. In such a preferred embodiment, each unit essentially comprises: four parallel wire members, the first and second of which define a base, and the third and fourth of which define a top; a first L-shaped flange and a second, parallel L-shaped flange, wherein said first and second L-shaped flanges are attached and parallel to said first and third wire members, respectively, and wherein further the first and second L-shaped flanges have their own respective receiving portions that face each other; a third L-shaped flange and a fourth, parallel L-shaped flange, wherein said third and fourth L-shaped flanges are attached and parallel to said third and fourth wire members, respectively, and wherein further the third and fourth L-shaped flanges each have their own respective receiving portions that face each other.

The present invention provides a modular wire-rack display system that is capable of rearrangement without removing the product being displayed. Each wire-rack unit has integrated connecting members for robustness and ease of use. Furthermore, a preferred embodiment of the modular wire-rack display system is capable of gravity-fed product display.

The invention accordingly comprises the features described more fully below, and the scope of the invention will be indicated in the claims. Further objects of the present invention will become apparent in the following detailed description.

BRIEF DESCRIPTION OF THE DRAWINGS

The novel features which are characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

Like reference numerals represent equivalent parts throughout the several drawings.

REFERENCE NUMERALS

Figure 1:
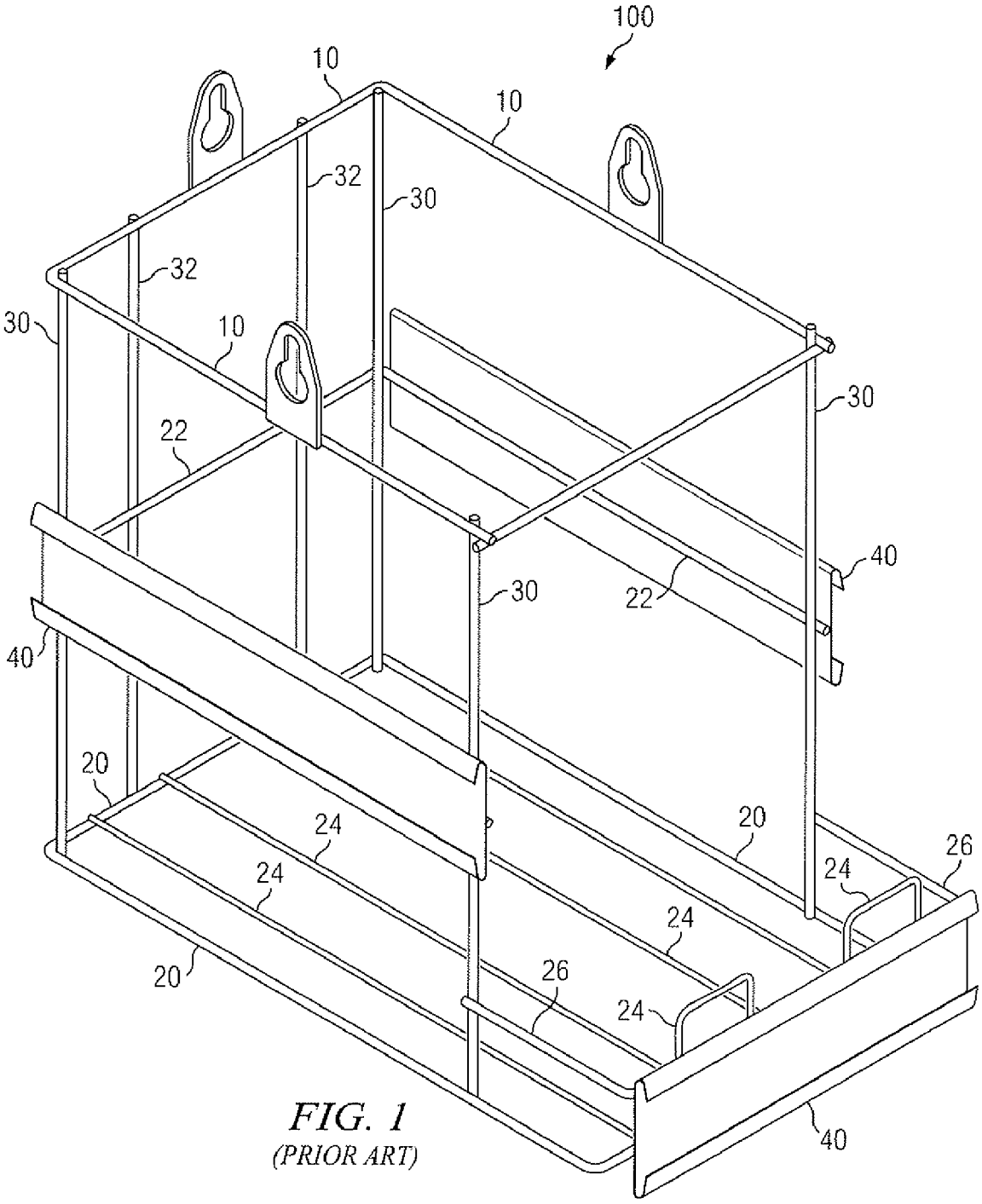
FIG. 1 (PRIOR ART)
FIG. 1 is a perspective view of a prior art, modular wire-rack unit.
Figure 2:
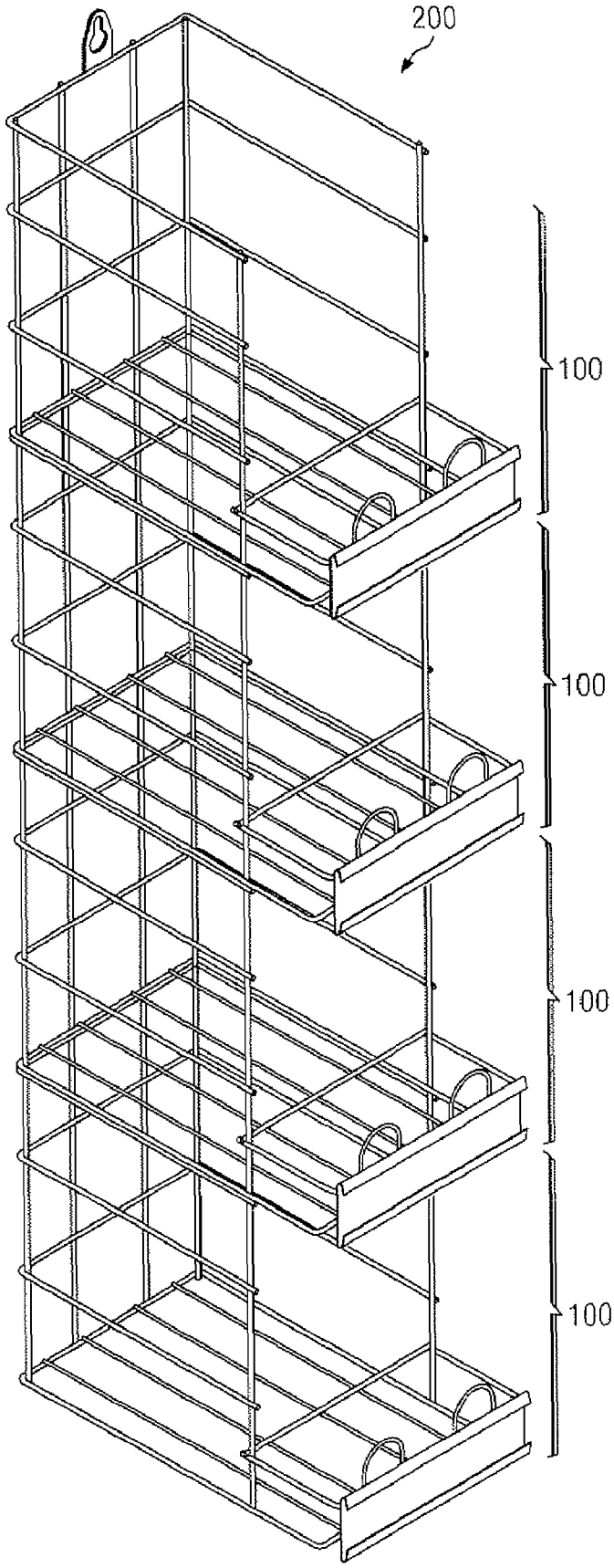
FIG. 2 (PRIOR ART)
FIG. 2 is a perspective view of several of the prior art units shown in FIG. 1 stacked vertically.

10 top-surface wire member
20 bottom-surface wire member
22 lateral supporting wire member
24 bottom longitudinal wire member
26 lateral label-supporting wire member
30 vertical corner wire member
32 vertical supporting wire member
40 label holder
100 prior-art modular wire-rack unit
200 prior-art modular wire-rack display system
300 modular wire-rack unit (in accordance with a preferred embodiment)
301 first wire member
302 second wire member
303 third wire member
304 fourth wire member
311 first L-shaped flange
312 second L-shaped flange
313 third L-shaped flange
314 fourth L-shaped flange
320 bottom-surface longitudinal wire member
322 bottom-surface rear wire member
324 front upright wire member
326 side U-shaped wire member
328 side vertical supporting wire member
330 label holder
332 upper rear lateral wire member
338 vertical rear-corner wire member
340 wall mount
700 modular wire-rack display system (in accordance with a preferred embodiment)
800 modular wire-rack unit (in accordance with another embodiment)
801 first wire member
802 second wire member
803 third wire member
804 fourth wire member
811 first L-shaped flange
812 second L-shaped flange
813 third L-shaped flange
814 fourth L-shaped flange
820 bottom-surface longitudinal wire member
822 bottom-surface rear wire member
826 product-guiding U-shaped wire member
828 side vertical U-shaped supporting wire member
830 label holder
838 vertical rear-corner wire member
900 modular wire-rack display system, side-by-side
1000 modular wire-rack display system, bottom-to-top
1100 modular wire-rack unit (in accordance with yet another embodiment)
1101 first wire member
1102 second wire member
1103 third wire member
1104 fourth wire member
1111 first L-shaped flange
1112 second L-shaped flange
1113 third L-shaped flange
1114 fourth L-shaped flange
1120 bottom-surface longitudinal wire member
1122 bottom-surface rear wire member
1126 product-guiding U-shaped wire member
1128 side vertical U-shaped supporting wire member
1130 label holder
1132 upper rear lateral wire member
1138 vertical rear-corner wire member
1200 modular wire-rack display system, side-by-side
1300 modular wire-rack display system, bottom-to-top

DETAILED DESCRIPTION OF THE INVENTION

Referring now to the provided drawings, similar reference numerals represent the equivalent component throughout the several views of the drawings.

Figure 3:
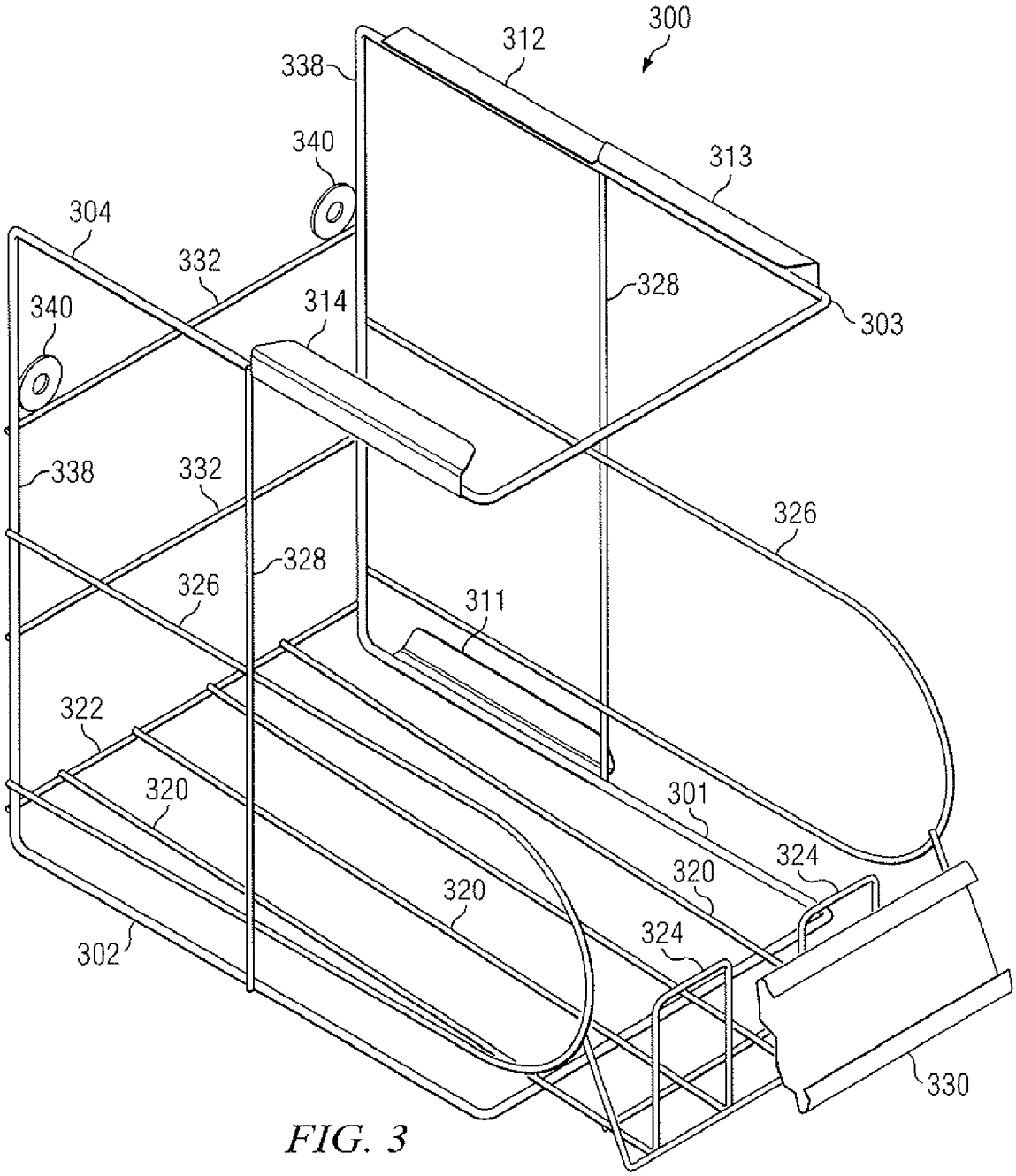
FIG. 3 is a perspective view of a modular wire-rack unit in accordance with a preferred embodiment of the present invention.
Figure 4:
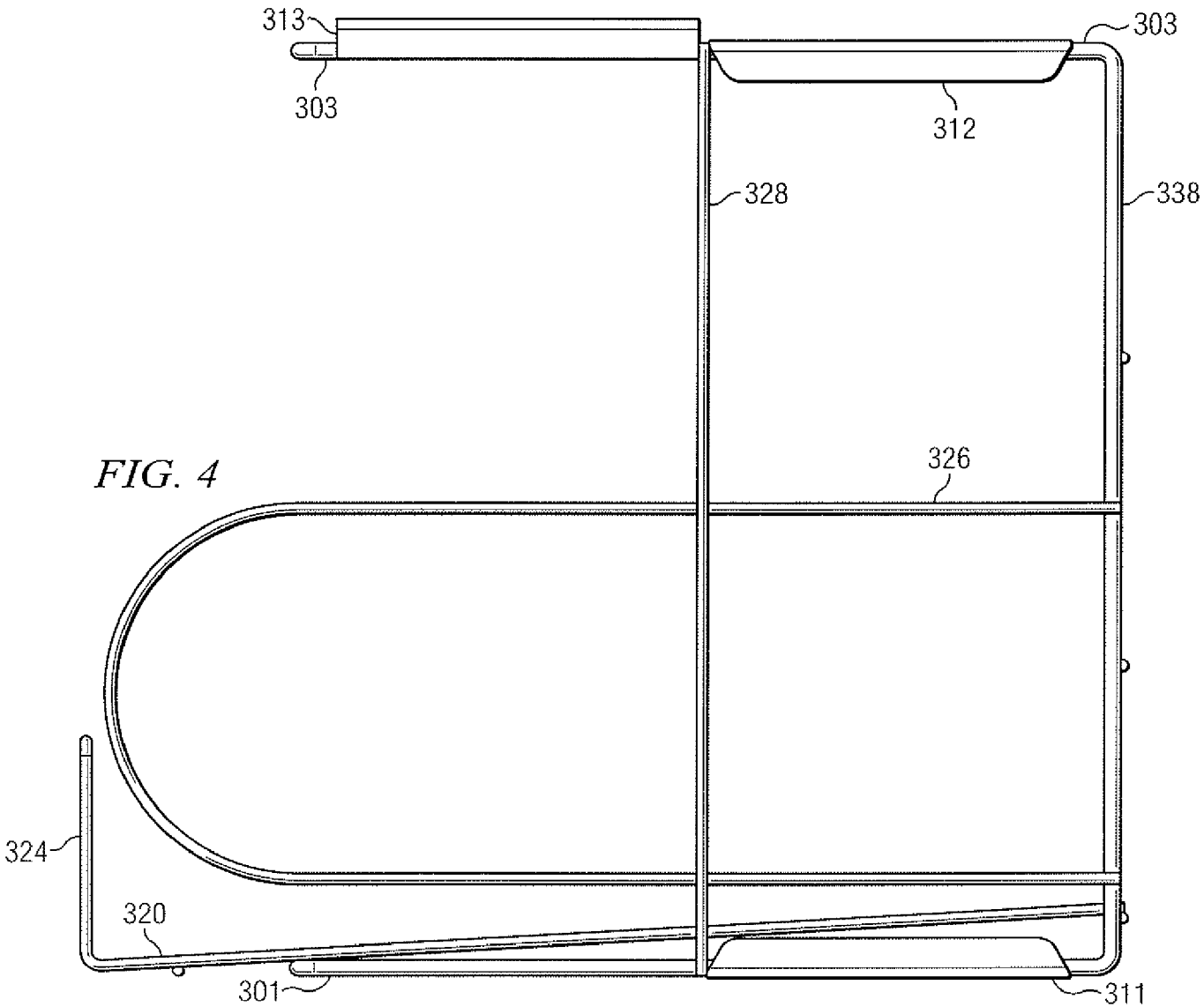
FIG. 4 is an elevated side view of the modular wire-rack unit shown in FIG. 3.
Figure 5:
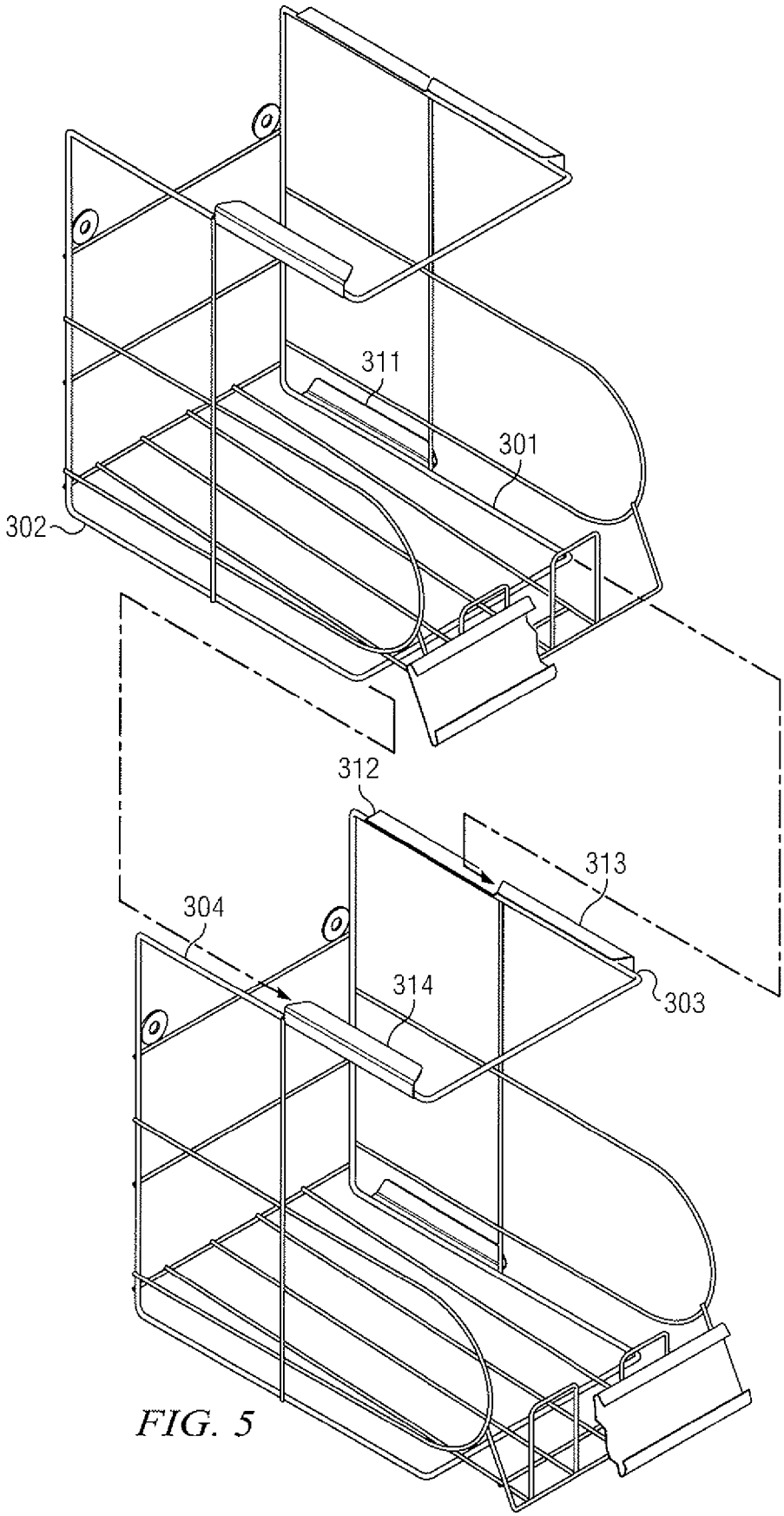
FIG. 5 is a perspective view of two modular wire-rack units prior to being joined in a vertical, bottom-to-top arrangement.
Figure 6:
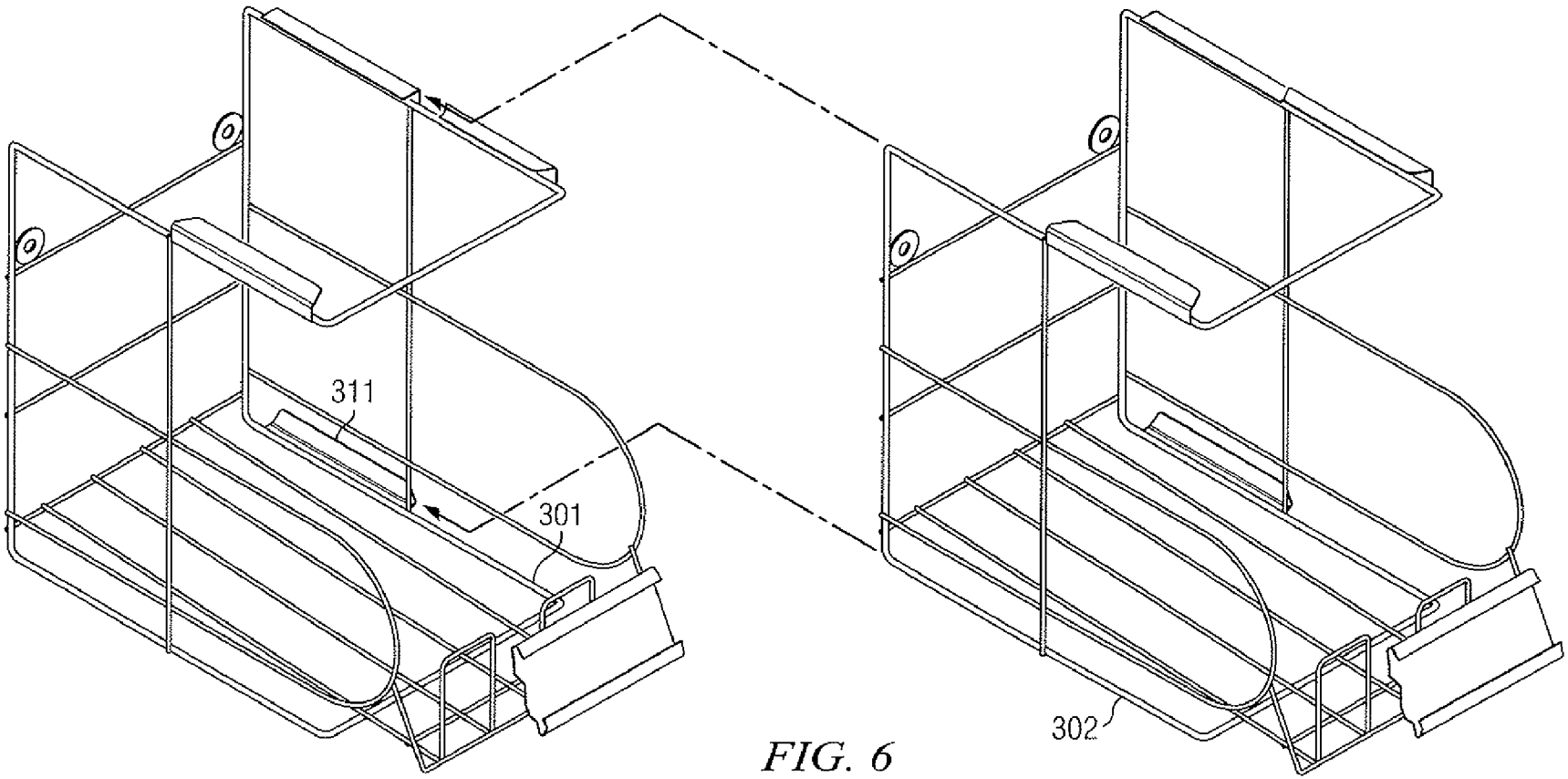
FIG. 6 is a perspective view of two modular wire-rack units prior to being joined in a horizontal, side-by-side arrangement.
Figure 7:
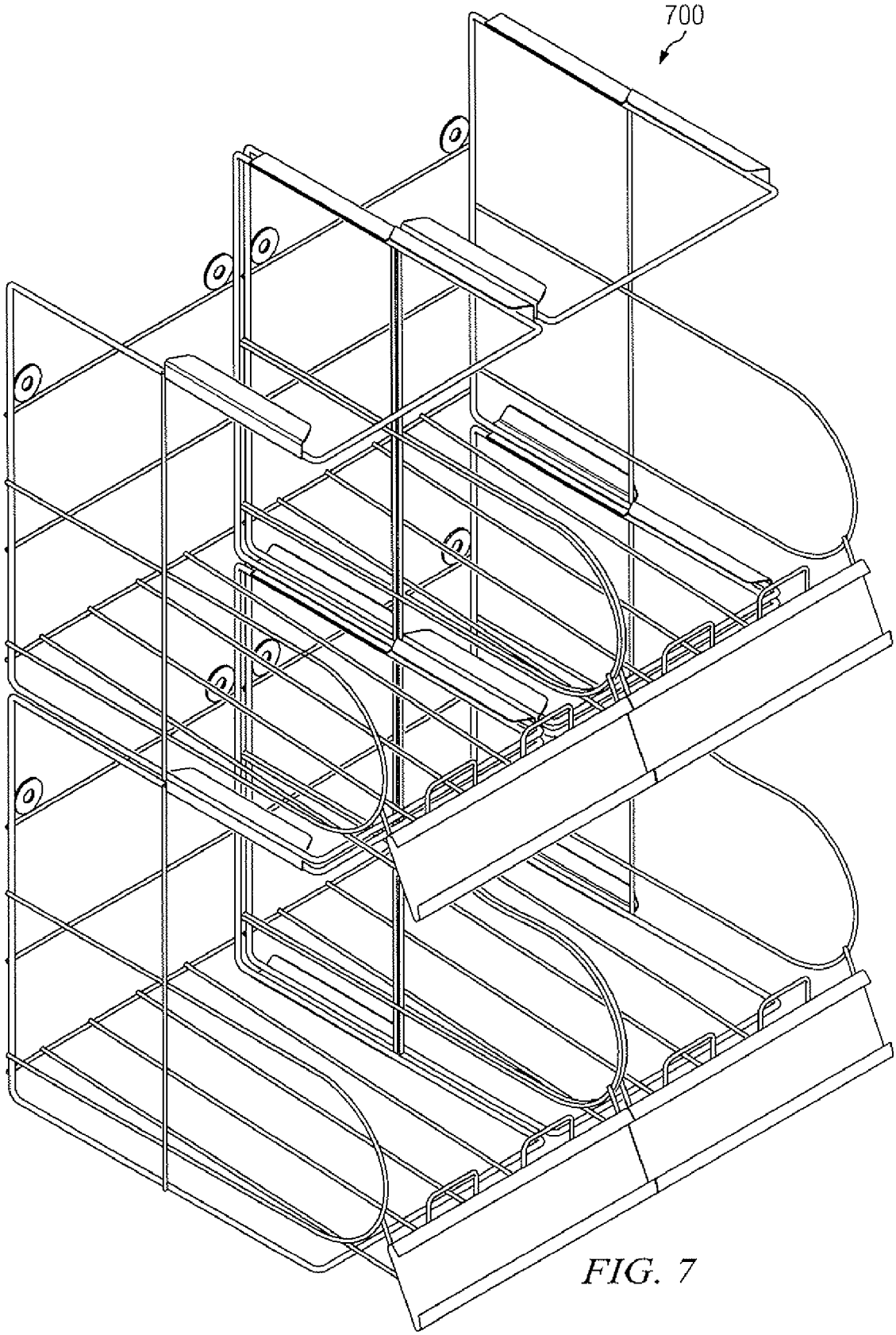
FIG. 7 is a perspective view of a modular wire-rack system comprising four units joined together in a two-by-two arrangement.

FIG. 3 is a perspective view of a modular wire-rack unit in accordance with a preferred embodiment of the present invention. FIG. 4 is an elevated side view of the modular wire-rack unit shown in FIG. 3. FIG. 5 is a perspective view of two modular wire-rack units prior to being joined in a vertical, bottom-to-top arrangement. FIG. 6 is a perspective view of two modular wire-rack units prior to being joined in a horizontal, side-by-side arrangement. FIG. 7 is a perspective view of a nodular wire-rack system comprising four units joined together in a two-by-two arrangement.

Referring to the above-mentioned figures, a preferred embodiment of the present invention comprises a plurality of interlocking, modular, wire-frame storage units, with each of the modular units having built-in connecting members, and where the modular units are capable of tessellation (patterned, repetitive attachment). In particular, each unit 300 has two parallel, top and bottom surfaces. The top surface is defined by a first wire member 301 and a second wire member 302, wherein the second wire member 302 is parallel to the first wire member 301 in the horizontal plane. The bottom surface is defined by a third wire member 303 and a fourth wire member 304, wherein the third wire member 303 is parallel to the first wire member 301 in the vertical plane, the third wire member 303 is above the first wire member 301) the fourth wire member 304 is parallel to the third wire member 303 in the horizontal plane, and the fourth wire member 304 is parallel to the second wire member 302 in the vertical plane. Furthermore, the first wire member 301 is connected to the second wire member 302 and the third wire member 303. The second wire member 302 is also connected to the fourth wire member 304.

Referring to the built-in, unit-to-unit connectors 311, 312, 313, 314, each one of the units 300 has: a first L-shaped flange 311 having a receiving portion, wherein the first L-shaped flange 311 is attached and parallel to the first wire member 301; a second L-shaped flange 312 having a receiving portion, wherein the second L-shaped flange 312 is attached and parallel to the third wire member 303, and wherein further the receiving portions of the first and second L-shaped flanges 311, 312 face each other; a third L-shaped flange 313 having a receiving portion, wherein the third L-shaped flange 313 is attached and parallel to the third wire member 301; and a fourth L-shaped flange 314 having a receiving portion, wherein the fourth L-shaped flange 314 is attached and parallel to the fourth wire member 304, and wherein further the receiving portions of the third and fourth L-shaped flanges 313, 314 face each other.

The wire members defining the top and bottom surfaces, together with their respective L-shaped flanges (connectors), enable each unit to attach to one or more adjacent unit(s), as illustrated in the figures. As shown in FIG. 5, for example, a first unit (upper unit) can be attached atop a second unit (lower unit) by first positioning the first/upper unit above and slightly behind the second/lower unit, aligning the bottom-surface-defining first and second wire members 301, 302 of the first/upper unit with the top-surface-defining third and fourth wire members 303, 304 of the second/lower unit, and finally sliding the entire first/upper unit forward until vertically aligned with the second/lower unit. When properly attached, the first wire member 301 of the first/upper unit is nested within the receiving portion of the third L-shaped flange 313 of the second/upper unit, and the second wire member 302 of the first/upper unit is nested within the receiving portion of the fourth L-shaped flange 314 of the second/upper unit. Thus, the first/upper unit rests atop the second/tower unit and is secured by the third and fourth L-shaped flange connectors 313, 314 of the second/lower unit.

Similarly, as illustrated in FIG. 6, a first/left unit and second/right unit can be joined horizontally, in a side-by-side arrangement. Beginning with the second/right unit positioned to the left slightly and ahead of the first/left unit, the second wire member 302 of the second/right unit is aligned with the first wire member 301 of the first/left unit. Next, the entire second unit is moved rearward until aligned horizontally with the first unit so that the second unit's second wire member 302 engages with the first L-shaped flange 311 of the first/left unit, and also so that the second unit's fourth wire member 304 engages with the second L-shaped flange 312 of the first/left unit.

As illustrated in FIG. 7, the above-described procedures for horizontal and vertical attachment can be combined to form a sturdy grid 700 of wire-frame product display racks. Unlike many prior art modular wire-rack display systems, the nodular display system of the current invention is capable of assembly by connecting units together directly rather than requiring separate connectors. Furthermore, the L-shaped flange connectors of the present invention provide robust attachment between units, thereby enabling the entire display system to be strong enough to withstand movement and/or relocation without removing product from the individual units.

In a preferred embodiment, each modular unit 300 has an inclined product-supporting bottom surface (inclined from front to back; declined from back to front). Such an inclined surface enables a gravity-fed product display. As illustrated in FIGS. 3-7, an inclined product-supporting bottom surface is defined by a plurality of bottom-surface longitudinal wire members 320 spanning from the lower-front extremity of the unit to a bottom-surface rear wire member 322, which is elevated above the first and second wire members 301, 302 and is secured at either side to two vertical rear-corner wire members 338.

Aside from the top-defining and bottom-defining wire members and their respective L-shaped flange connectors, the exact construction of each wire-frame unit is not critical and may vary. Thus, while particular supporting elements may be shown in the Figures, many elements are non-critical to the present invention and are therefore optional. For example, in FIGS. 3-7, variable non-critical elements include: front upright wire members 324; side U-shaped wire members 326; side vertical supporting wire members 328; label holders 330; upper rear lateral wire members 332; vertical rear-corner wire member 338; and wall mounts 340. In one exemplary embodiment, the dimensions of the wire-frame unit are as follows: roughly 15 centimeters (cm) wide, 25.5 cm long (excluding the label holders), and 23 cm tall, with a product-supporting bottom surface incline of about 2 or 3 degrees. Each half of each L-shaped flange connector is about 9 cm long and about 1 cm wide. The wire is about 3 to 4 millimeters in diameter. Note, however, that these dimensions apply to merely one specific embodiment and are not intended to limit the many other possible embodiments encompassed by the present invention.

Figure 8:
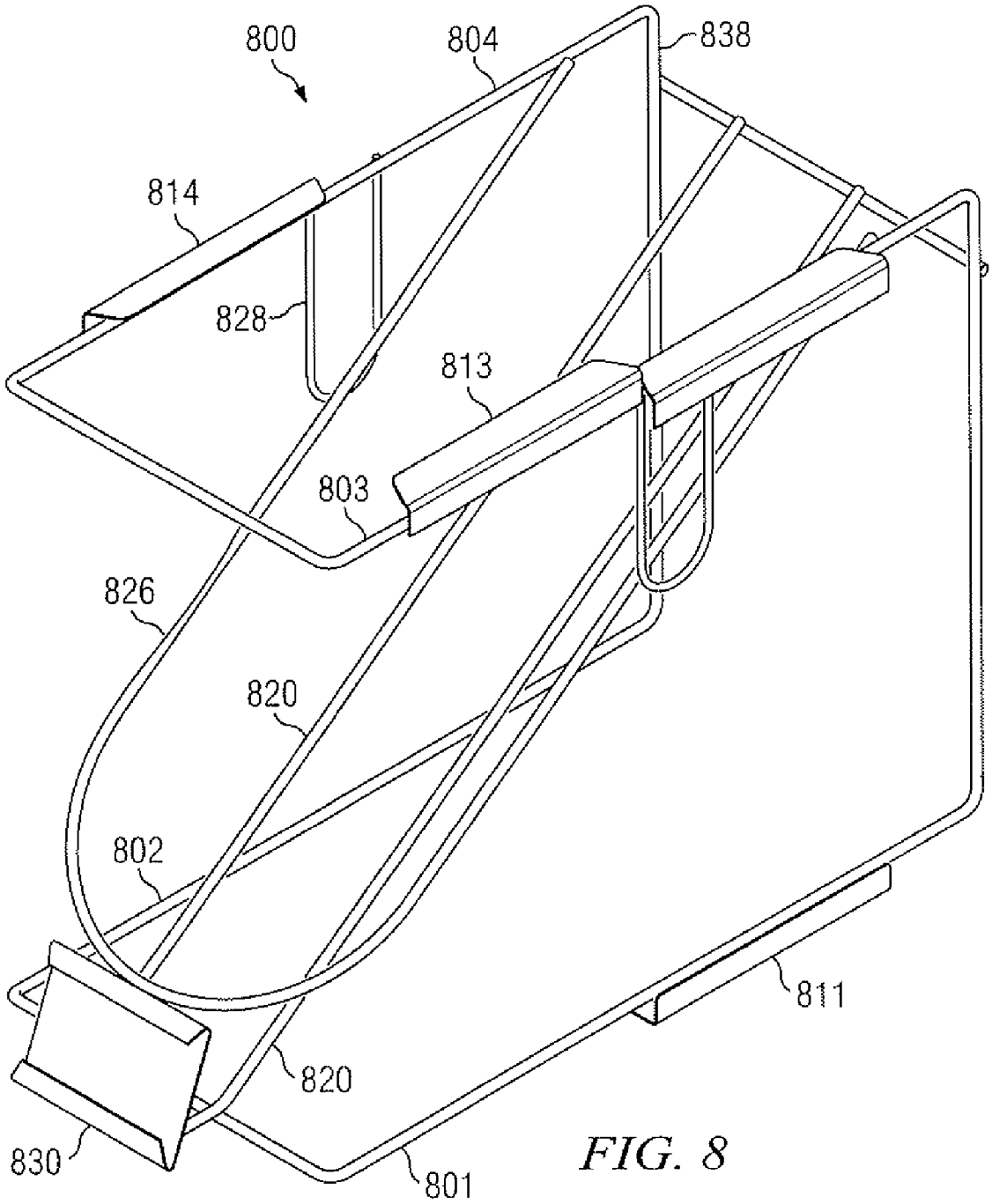
FIG. 8 is a perspective view of a modular wire-rack unit in accordance with another embodiment of the present invention.
Figure 9:
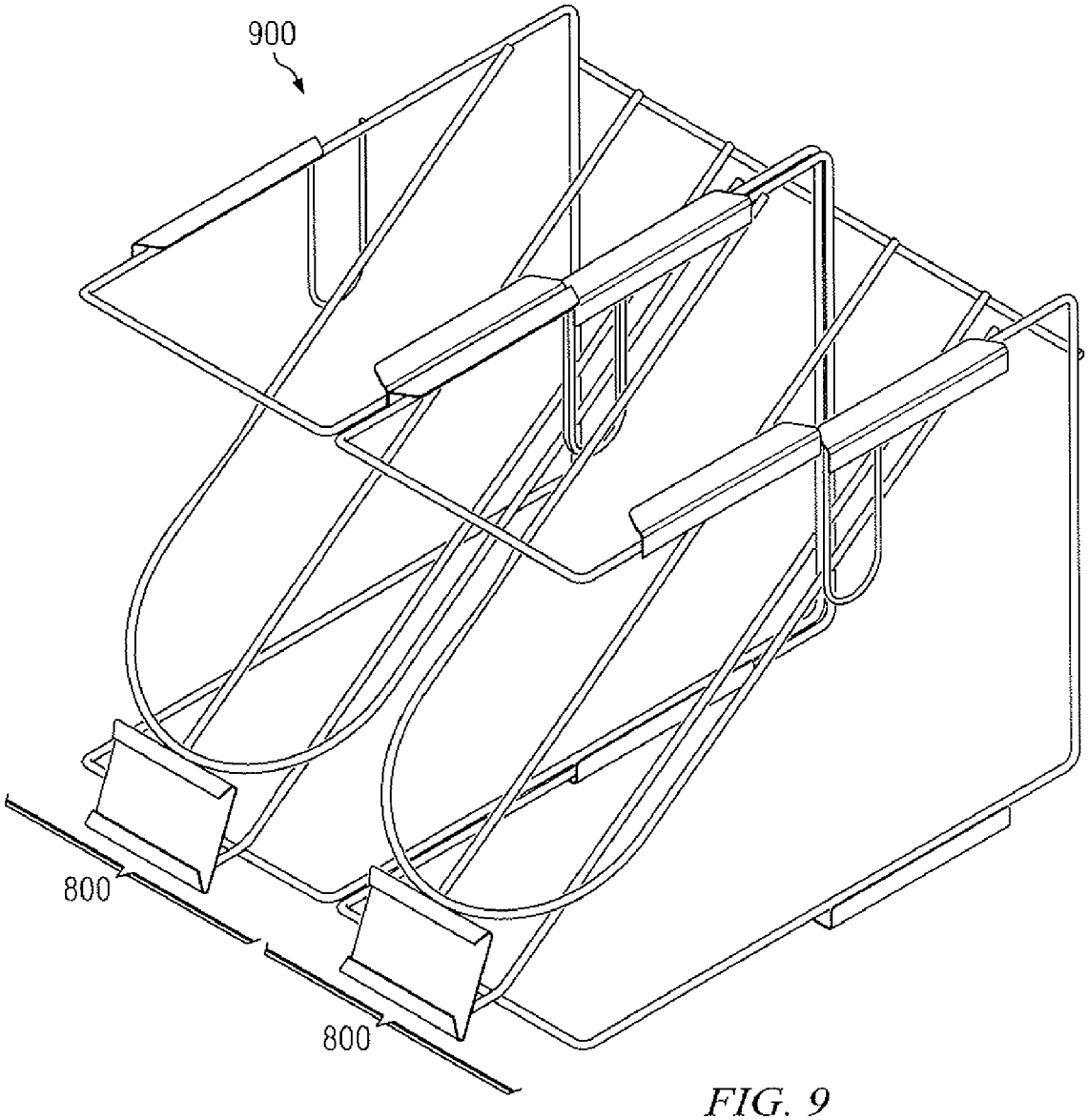
FIG. 9 is a perspective view of two of the units shown in FIG. 8 joined in a side-by-side, horizontal arrangement.
Figure 10:
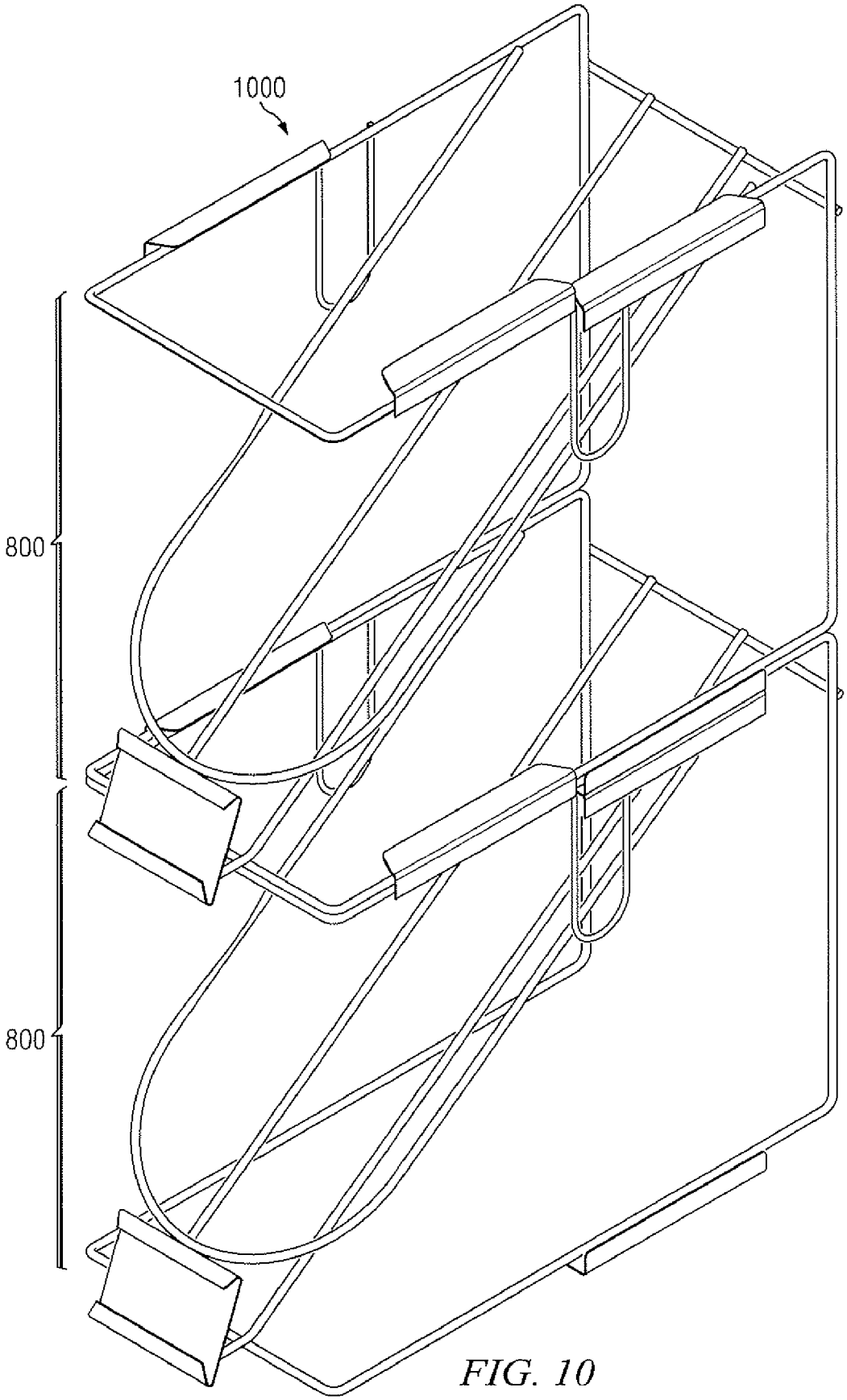
FIG. 10 is a perspective view of two of the units shown in FIG. 8 joined in a vertical, bottom-to-top arrangement.
Figure 11:
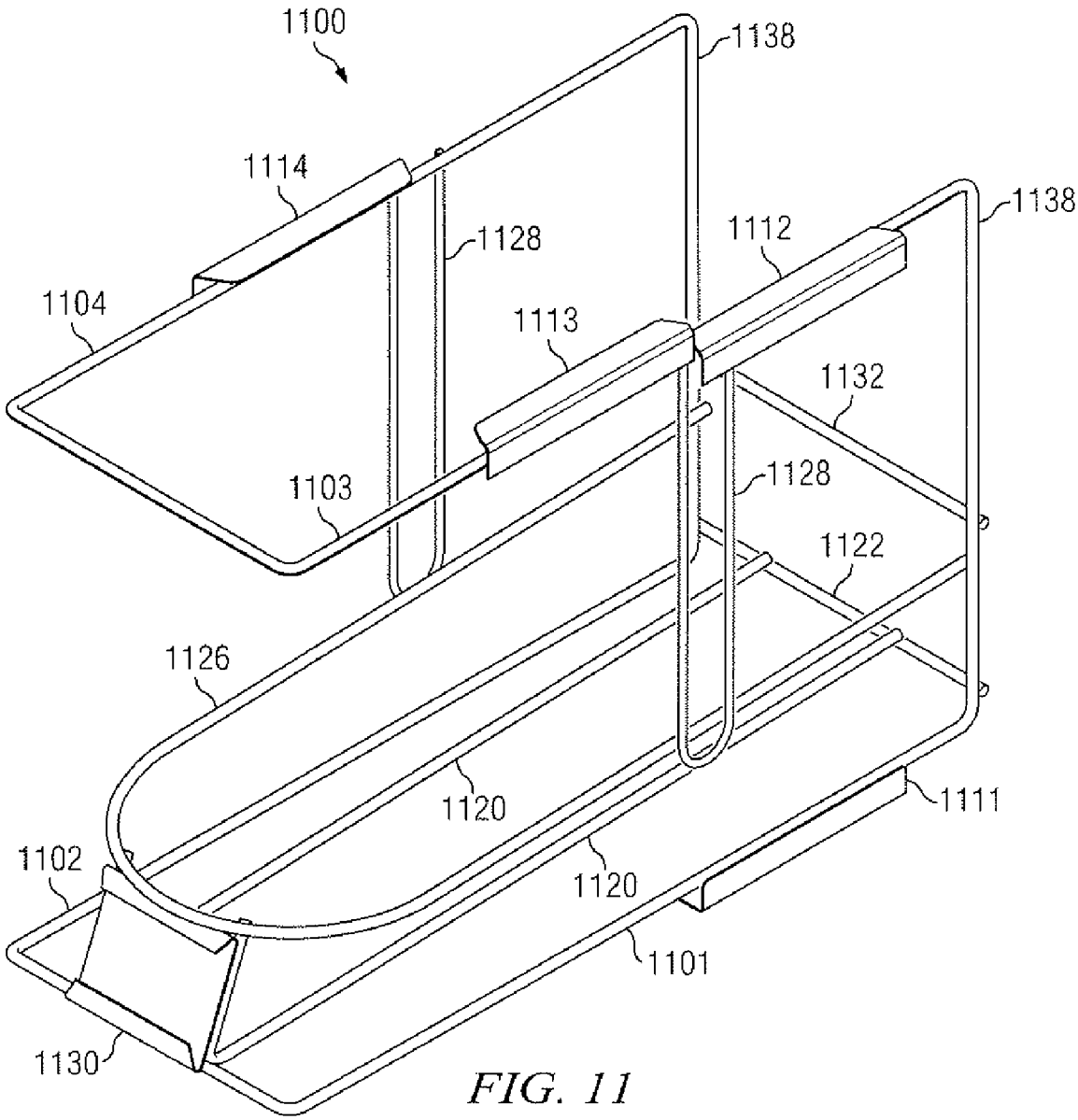
FIG. 11 is a perspective view of a modular wire-rack unit in accordance with yet another embodiment of the present invention.
Figure 12:
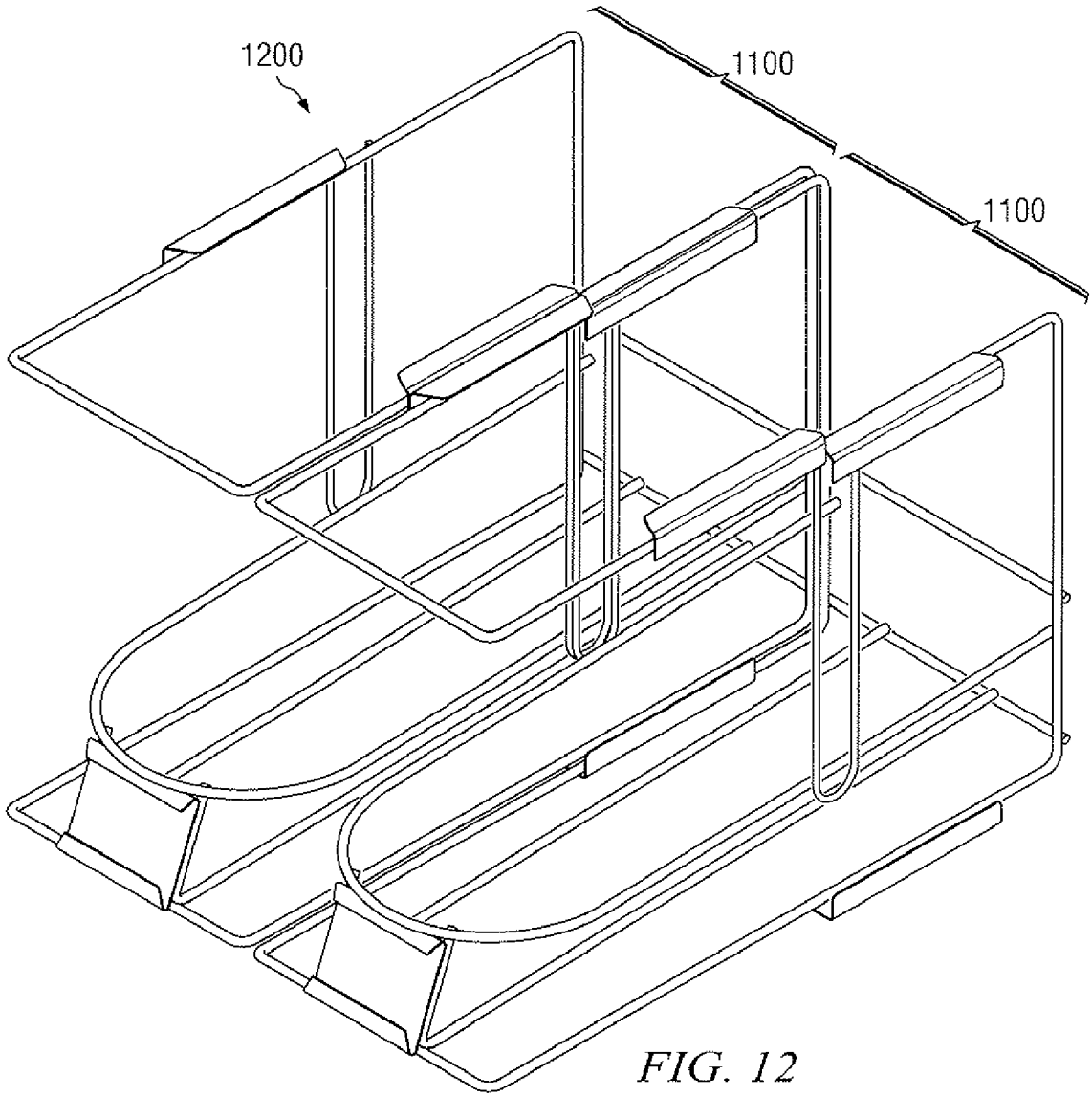
FIG. 12 is a perspective view of two of the units shown in FIG. 11 joined in a side-by-side, horizontal arrangement.
Figure 13:
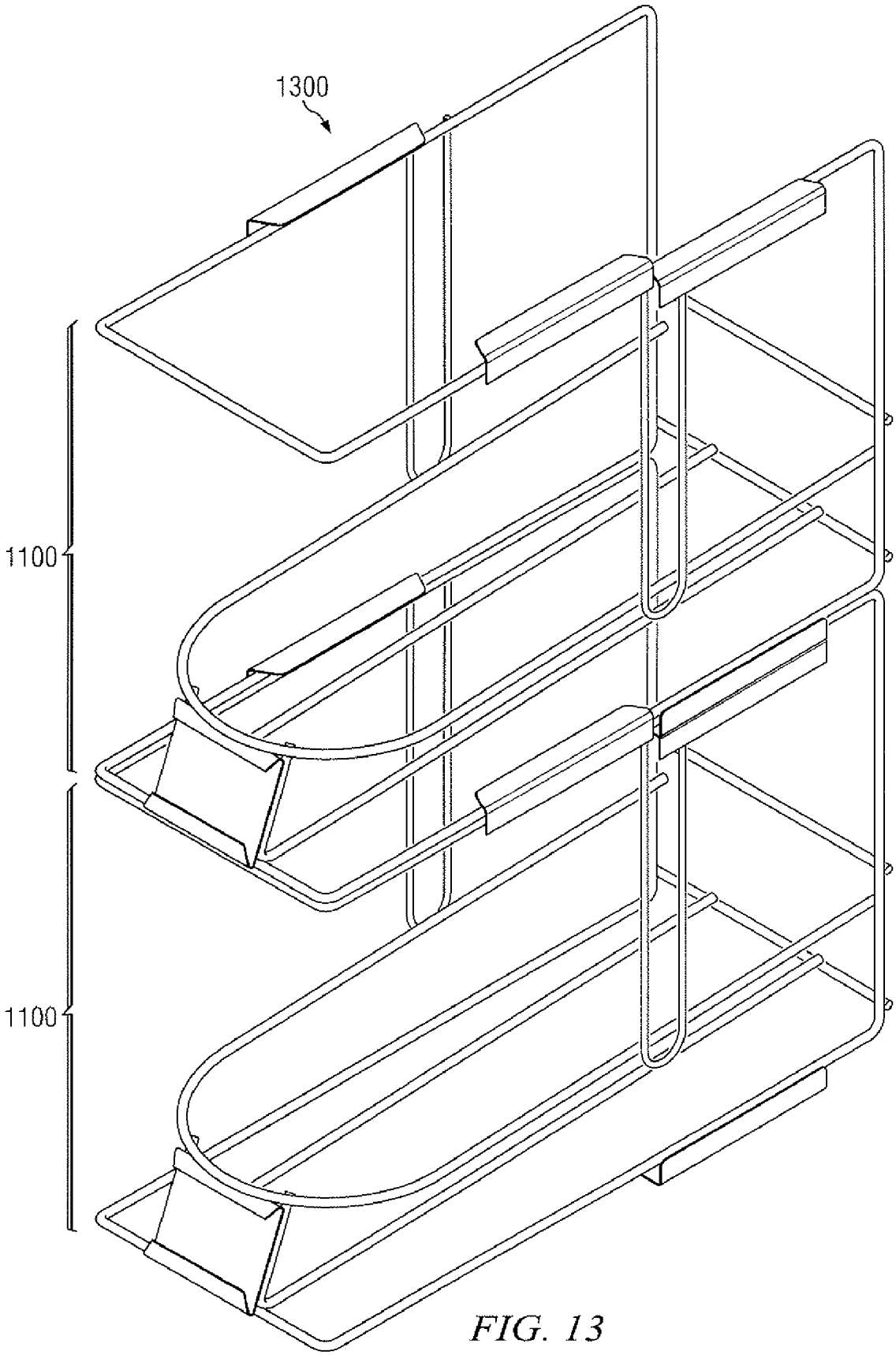
FIG. 13 is a perspective view of two of the units shown in FIG. 11 joined in a vertical, bottom-to-top arrangement.

FIG. 8 is a perspective view of a modular wire-rack/wire-frame unit in accordance with another embodiment of the present invention. FIG. 9 is a perspective view of two of the units shown in FIG. 8 joined in a side-by-side, horizontal arrangement. FIG. 10 is a perspective view of two of the units shown in FIG. 8 joined in a vertical, bottom-to-top arrangement. The wire-frame unit embodiment shown in FIGS. 8-10 is similar to that shown in FIGS. 3-7, except that the product-supporting bottom surface has a steeper incline. FIG. 11 is a perspective view of a modular wire-rack unit in accordance with yet another embodiment of the present invention. FIG. 12 is a perspective view of two of the units shown in FIG. 11 joined in a side-by-side, horizontal arrangement. FIG. 13 is a perspective view of two of the units shown in FIG. 11 joined in a vertical, bottom-to-top arrangement. The wire-frame unit embodiment shown in FIGS. 11-13 is also similar to that shown in FIGS. 3-7, except that the product-supporting bottom surface has only a slight incline. The critical elements for unit-to-unit attachment, however, resemble those of the previously-discussed embodiment, and their purpose and operation are identical. Thus, the unit-attachment discussion—regarding the first wire member 301, second wire member 302, third wire member 303, fourth wire member 304, first L-shaped flange 311, second L-shaped flange 312, third L-shaped flange 313, and fourth L-shaped flange 314 of the embodiment shown in FIGS. 3-7 also applies to the first wire member 801, second wire member 802, third wire member 803, fourth wire member 804, first L-shaped flange 811, second L-shaped flange 812, third L-shaped flange 813, and fourth L-shaped flange 814 of the embodiment shown in FIGS. 8-10. Likewise, the unit-attachment discussion also applies to the first wire member 1101, second wire member 1102, third wire member 1103, fourth wire member 1104, first L-shaped flange 1111, second L-shaped flange 1112, third L-shaped flange 1113, and fourth L-shaped flange 1114 of the embodiment shown in FIGS. 11-13.

In FIGS. 8-10, the non-critical, optional, variable elements include: bottom-surface longitudinal wire members 820; bottom-surface rear wire members 822; product-guiding U-shaped wire members 826; side vertical U-shaped supporting wire members 828, label holders 830; and vertical rear-corner wire members 838. In one exemplary embodiment, the dimensions of the wire-frame unit are as follows: roughly 12.5 centimeters (cm) wide, 27 cm long (excluding the label holders), and 21 cm tall, with a product-supporting bottom surface incline of about 35 degrees. Each half of each L-shaped flange connector is about 9 cm long and about 1 cm wide. The wire is about 3 to 4 millimeters in diameter. Note, however, that these dimensions apply to merely one specific embodiment and are not intended to limit the many other possible embodiments encompassed by the present invention.

In FIGS. 11-13, the non-critical, optional, variable elements include: bottom-surface longitudinal wire members 1120; bottom-surface rear wire members 1122; product-guiding U-shaped wire members 1126; side vertical U-shaped supporting wire members 1128; label holders 1130; upper rear lateral wire members 1132; and vertical rear-corner wire members 1138. In one exemplary embodiment, the dimensions of the wire-frame unit are as follows: roughly 12.5 centimeters (cm) wide, 30 cm long (excluding the label holders), and 21 cm tall, with a product-supporting bottom surface incline of about 2 to about 3 degrees. Each half of each L-shaped flange connector is about 9 cm long and about 1 cm wide. The wire is about 3 to 4 millimeters in diameter. Note, however, that these dimensions apply to merely one specific embodiment and are not intended to limit the many other possible embodiments encompassed by the present invention.

All of the dimensions provided for the two described embodiments can be easily varied in order to meet the needs of any particular display rack. While there are many standard sizes of commercial display racks, there can be significant variations that would necessitate adjustments to the required dimensions. The specific embodiment disclosed is most suitable for the display of single-serving size salty snack packages, such as bags of potato chips and tortilla chips. However, the invention is suitable for the display of any product that works in a gravity feed system, such as bagged products, canned products, books, pamphlets, boxed products, canisters and bundled products. General fabrication and assembly of wire-frame articles are well-known in the art and need not be discussed in further detail. While specific embodiments of the invention have been disclosed, one of ordinary skill in the art will recognize that one can modify the dimensions and particulars of the embodiments without straying from the inventive concept.

We claim:

1. A product display rack comprising:

a plurality of interlocking modular units, each one of said modular units comprising:

a first wire member;

a second wire member, wherein said second wire member is parallel to said first wire member in a first horizontal plane located at the bottom of the unit;

a third wire member, wherein said third wire member is parallel to said first wire member in a first vertical plane, and wherein further said third wire member is above said first wire member;

a fourth wire member, wherein:

said fourth wire member is parallel to said third wire member in a second horizontal plane forming the top of the unit;

said fourth wire member is parallel to said second wire member in a second vertical plane;

said first wire member is connected to said second wire member and said third wire member;

said second wire member is connected to said fourth wire member;

a first L-shaped flange having a vertical portion and a horizontal portion defining a receiving portion to receive one of the wire members of another one of said modular units, wherein said first L-shaped flange is attached to said first wire member such that the first L-shaped flange extends parallel to the first wire member;

a second L-shaped flange having a vertical portion and a horizontal portion defining a receiving portion to receive one of the wire members of another one of said modular units, wherein said second L-shaped flange is attached to said third wire member such that the second L-shaped flange extends parallel to the third wire member, and wherein further the vertical portions of the first and second L-shaped flanges extend towards each other;

a third L-shaped flange having a vertical portion and a horizontal portion defining a receiving portion to receive one of the wire members of another one of said modular units, wherein said third L-shaped flange is attached to said third wire member such that the third L-shaped flange extends parallel to the third wire member;

a fourth L-shaped flange having a vertical portion and a horizontal portion defining a receiving portion to receive one of the wire members of another one of said modular units, wherein said fourth L-shaped flange is attached to said fourth wire member such that the fourth L-shaped flange extends parallel to the fourth wire member, and wherein further the horizontal portions of the third and fourth L-shaped flanges extends towards each other; and wherein the plurality of modular units comprises at least two of said modular units, wherein the second wire member of a first one of said units is received in the first flange of a second one of said units; and further wherein the fourth wire member of the first unit is received in the second flange of the second unit, thereby interlocking the first and second units in a side-by-side arrangement.

2. The product display rack of claim 1 comprising at least three of said modular units, wherein the first wire member of said first unit unit is received in the third flange of a third unit, and further wherein the second wire member of the first unit is received in the fourth flange of the third unit, thereby interlocking the first and third units in a bottom-to-top arrangement.

3. The product display rack of claim 1 comprising at least three of said modular units, wherein the first wire member of said second unit is received in the third flange of a third unit, and further wherein the second wire member of the second unit is received in the fourth flange of the third unit, thereby interlocking the second and third units in a bottom-to-top arrangement.

4. The product display rack of claim 1 wherein the plurality of modular units comprises at least three of said modular units, wherein at least one of said at least three of said modular units is adjacent to, and interlocked with, at least two of said at least three of said modular units.

5. The product display rack of claim 1, wherein said second wire member is connected to said fourth wire member by a first vertical member, and wherein said first wire member is connected to said third wire member by a second vertical member, and wherein each modular unit comprises an inclined, product-supporting, bottom surface, thereby enabling a gravity-fed product display, wherein said bottom surface spans from a lower front of said modular unit to a rear wire member, wherein said rear wire member is elevated above the first and second wire members, and wherein said rear wire member is secured at each end to said first and second vertical members.

6. The product display rack of claim 1, wherein said second wire member is connected to said fourth wire member by a first vertical member, and wherein said first wire member is connected to said third wire member by a second vertical member, and wherein each modular unit comprises an inclined, product-supporting, bottom surface having an incline of about 2 degrees to about 3 degrees from horizontal, wherein said bottom surface spans from a lower front of said modular unit to a rear wire member, wherein said rear wire member is elevated above the first and second wire members, and wherein said rear wire member is secured at each end to said first and second vertical members.

7. The product display rack of claim 1, wherein said second wire member is connected to said fourth wire member by a first vertical member, and wherein said first wire member is connected to said third wire member by a second vertical member, and wherein each modular unit comprises an inclined, product-supporting, bottom surface having an incline of about 35 degrees from horizontal, wherein said bottom surface spans from a lower front of said modular unit to a rear wire member, wherein said rear wire member is elevated above the first and second wire members, and wherein said rear wire member is secured at each end to said first and second vertical members.

8. The product display rack of claim 1 wherein each one of said units is about 15 centimeters wide, 25.5 centimeters long, and 23 centimeters tall, wherein wide is the dimension perpendicular to said first and second wire members in a horizontal direction, wherein long is the dimension parallel to said first and second wire members in a horizontal direction, and wherein tall is the dimension perpendicular to said first and third wire members in a vertical direction.

9. The product display rack of claim 1 wherein each one of said units is about 12.5 centimeters wide, 27 centimeters long, and 21 centimeters tall, wherein wide is the dimension perpendicular to said first and second wire members in a horizontal direction, wherein long is the dimension parallel to said first and second wire members in a horizontal direction, and wherein tall is the dimension perpendicular to said first and third wire members in a vertical direction.

10. The product display rack of claim 1 wherein each one of said units is about 12.5 centimeters wide, 30 centimeters long, and 21 centimeters tall, wherein wide is the dimension perpendicular to said first and second wire members in a horizontal direction, wherein long is the dimension parallel to said first and second wire members in a horizontal direction, and wherein tall is the dimension perpendicular to said first and third wire members in a vertical direction.

11. The product display rack of claim 1 wherein each L-shaped flange is about 9 centimeters long and about 1 centimeter wide, wherein wide is the dimension perpendicular to said first and second wire members in a horizontal direction, and wherein long is the dimension parallel to said first and second wire members in a horizontal direction.

12. A product display rack comprising:

a plurality of interlocking modular units, each one of said modular units comprising:

a first wire member;

a second wire member, wherein said second wire member is parallel to said first wire member in a first horizontal plane located at the bottom of the unit;

a third wire member, wherein said third wire member is parallel to said first wire member in a first vertical plane, and wherein further said third wire member is above said first wire member;

a fourth wire member, wherein:

said fourth wire member is parallel to said third wire member in a second horizontal plane forming the top of the unit;

said fourth wire member is parallel to said second wire member in a second vertical plane;

said first wire member is connected to said second wire member and said third wire member;

said second wire member is connected to said fourth wire member;

a first L-shaped flange having a vertical portion and a horizontal portion defining a receiving portion to receive one of the wire members of another one of said modular units, wherein said first L-shaped flange is attached to said first wire member such that the first L-shaped flange extends parallel to the first wire member;

a second L-shaped flange having a vertical portion and a horizontal portion defining a receiving portion to receive one of the wire members of another one of said modular units, wherein said second L-shaped flange is attached to said third wire member such that the second L-shaped flange extends parallel to the third wire member, and wherein further the vertical portions of the first and second L-shaped flanges extend towards each other;

a third L-shaped flange having a vertical portion and a horizontal portion defining a receiving portion to receive one of the wire members of another one of said modular units, wherein said third L-shaped flange is attached to said third wire member such that the third L-shaped flange extends parallel to the third wire member;

a fourth L-shaped flange having a vertical portion and a horizontal portion defining a receiving portion to receive one of the wire members of another one of said modular units, wherein said fourth L-shaped flange is attached to said fourth wire member such that the fourth L-shaped flange extends parallel to the fourth wire member, and wherein further the horizontal portions of the third and fourth L-shaped flanges extends towards each other; and wherein the plurality of modular units comprises at least two of said modular units, wherein the first wire member of a first one of said units is received in the third flange of the second one of said units, and further wherein the second wire member of the first unit is received in the fourth flange of the second unit, thereby interlocking the first and second units in a bottom-to-top arrangement.

13. The product display rack of claim 12 wherein the plurality of modular units comprises at least three of said modular units, wherein at least one of said at least three of said modular units is adjacent to, and interlocked with, at least two of said at least three of said modular units.

14. The product display rack of claim 12 wherein said second wire member is connected to said fourth wire member by a first vertical member, and wherein said first wire member is connected to said third wire member by a second vertical member, and wherein each modular unit comprises an inclined, product-supporting, bottom surface, thereby enabling a gravity-fed product display, wherein said bottom surface spans from a lower front of said modular unit to a rear wire member, wherein said rear wire member is elevated above the first and second wire members, and wherein said rear wire member is secured at each end to said first and second vertical members.

15. The product display rack of claim 12 wherein said second wire member is connected to said fourth wire member by a first vertical member, and wherein said first wire member is connected to said third wire member by a second vertical member, and wherein each modular unit comprises an inclined, product-supporting, bottom surface having an incline of about 2 degrees to about 3 degrees from horizontal, wherein said bottom surface spans from a lower front of said modular unit to a rear wire member, wherein said rear wire member is elevated above the first and second wire members, and wherein said rear wire member is secured at each end to said first and second vertical members.

16. The product display rack of claim 12 wherein said second wire member is connected to said fourth wire member by a first vertical member, and wherein said first wire member is connected to said third wire member by a second vertical member, and wherein each modular unit comprises an inclined, product-supporting, bottom surface having an incline of about 35 degrees from horizontal, wherein said bottom surface spans from a lower front of said to a rear wire member, wherein said rear wire member is elevated above the first and second wire members, and wherein said rear wire member is secured at each end to said first and second vertical members.

17. The product display rack of claim 12 wherein each one of said units is about 15 centimeters wide, 25.5 centimeters long, and 23 centimeters tall, wherein wide is the dimension perpendicular to said first and second wire members in a horizontal direction, wherein long is the dimension parallel to said first and second wire members in a horizontal direction, and wherein tall is the dimension perpendicular to said first and third wire members in a vertical direction.

18. The product display rack of claim 12 wherein each one of said units is about 12.5 centimeters wide, 27 centimeters long, and 21 centimeters tall, wherein wide is the dimension perpendicular to said first and second wire members in a horizontal direction, wherein long is the dimension parallel to said first and second wire members in a horizontal direction, and wherein tall is the dimension perpendicular to said first and third wire members in a vertical direction.

19. The product display rack of claim 12 wherein each one of said units is about 12.5 centimeters wide, 30 centimeters long, and 21 centimeters tall, wherein wide is the dimension perpendicular to said first and second wire members in a horizontal direction, wherein long is the dimension parallel to said first and second wire members in a horizontal direction, and wherein tall is the dimension perpendicular to said first and third wire members in a vertical direction.

20. The product display rack of claim 12 wherein each L-shaped flange is about 9 centimeters long and about 1 centimeter wide, wherein wide is the dimension perpendicular to said first and second wire members in a horizontal direction, and wherein long is the dimension parallel to said first and second wire members in a horizontal direction.

* * * * *